US006399216B1

(12) United States Patent
Jayaweera et al.

(10) Patent No.: US 6,399,216 B1
(45) Date of Patent: Jun. 4, 2002

(54) CORROSION-RESISTANT COATINGS FOR STEELS USED IN BROMIDE-BASED ABSORPTION CYCLES

(75) Inventors: Palitha Jayaweera, Fremont; Angel Sanjurjo, San Jose; Kai-Hung Lau, Cupertino; Naixiong Jiang, Palo Alto; David M. Lowe, Hayward, all of CA (US)

(73) Assignee: Gas Research Institute, Des Plaines, IL (US)

( * ) Notice: Subject to any disclaimer, the term of this patent is extended or adjusted under 35 U.S.C. 154(b) by 0 days.

(21) Appl. No.: 09/610,923

(22) Filed: Jul. 6, 2000

Related U.S. Application Data

(63) Continuation-in-part of application No. 08/932,359, filed on Sep. 17, 1997, now abandoned.

(51) Int. Cl.[7] ..... B32B 15/04; C23C 26/00; F28F 19/06

(52) U.S. Cl. ..... 428/610; 428/627; 428/628; 428/667; 428/685; 428/629; 165/134.1

(58) Field of Search ..... 428/610, 685, 428/674, 676, 680, 687, 660, 661, 641, 627, 629, 628, 632, 667; 165/134.1, 180, 905; 148/537, 519, 206, 212

(56) References Cited

U.S. PATENT DOCUMENTS

| | | | | | |
|---|---|---|---|---|---|
| 3,669,851 | A | * | 6/1972 | Garvey | 204/25 |
| 4,040,870 | A | | 8/1977 | Holzl | 148/6.3 |
| 4,822,642 | A | | 4/1989 | Cabrera et al. | 427/255.1 |
| 5,149,514 | A | | 9/1992 | Sanjurjo | 423/344 |
| 5,364,659 | A | | 11/1994 | Rapp et al. | 427/253 |
| 5,455,068 | A | | 10/1995 | Aves et al. | 427/237 |
| 5,492,727 | A | | 2/1996 | Rapp et al. | 427/253 |
| 5,503,874 | A | | 4/1996 | Ackerman et al. | 427/237 |
| 5,543,183 | A | * | 8/1996 | Streckert et al. | 427/529 |
| 5,589,220 | A | | 12/1996 | Rapp et al. | 427/126.1 |
| 6,248,700 | B1 | * | 6/2001 | Vollmer et al. | 502/277 |

FOREIGN PATENT DOCUMENTS

| | | | |
|---|---|---|---|
| EP | 0488165 | | 6/1992 |
| JP | 02-298237 | * | 12/1990 |
| JP | 09-041097 | * | 2/1997 |
| JP | 10-204589 | * | 8/1998 |
| WO | WO 99/14400 | * | 3/1999 |

* cited by examiner

*Primary Examiner*—John J. Zimmerman
(74) *Attorney, Agent, or Firm*—Mark E. Fejer

(57) ABSTRACT

A method for coating stainless steel in which a metallic material layer of Cr and alloys of Cr and at least one of Mo, W, Ni, Si, Ti, Zr is deposited onto a metal substrate. The metallic material layer is then annealed so as to form a diffusion layer between the metallic protective coating and the metal substrate. Thereafter, the metallic material layer may be passivated, forming a stable composition of at least one of carbides, borides, nitrides, silicides, oxides, and mixtures thereof on the metallic protective coating. The protective coatings of this invention significantly reduce the corrosion rate of stainless steel used in bromide-based absorption systems.

10 Claims, 3 Drawing Sheets

CORROSION-RESISTANT COATINGS FOR STEELS USED IN BROMIDE-BASED ABSORPTION CYCLES

CROSS REFERENCE TO RELATED APPLICATION

This application is a continuation-in-part of U.S. patent application Ser. No. 08/932,359 filed Sep. 17, 1997 now abandoned.

BACKGROUND OF THE INVENTION

1. Field of the Invention

This invention relates to coatings for steels and other metals which are exposed to bromide environments, which coatings reduce the corrosion rate of said steels and other metals in the bromide environment. More particularly, this invention relates to coatings for steels and other metals used in bromide-based absorption cycles which reduce the rate of corrosion of said metals. The coatings of this invention allow use of low-cost steels as a construction material in place of expensive alloys, allow an increase in operating temperature of such bromide-absorption cycles, up to about 300° C., thereby enabling improvement in the coefficient of performance (COP), and result in extended service life, thereby reducing replacement and maintenance costs. Also disclosed is a method for coating such steels and other metals.

2. Description of Prior Art

Coatings are widely used for the corrosion protection of metals and other materials in a variety of environments. However, for each environment, different coatings may be required and, thus, careful selection and testing is necessary before a coating can be certified for a particular application.

The protection of steel in a variety of environments is the subject of many articles and patents. Although there are a large number of prior art patents and publications on corrosion in aqueous environments, it is not obvious from the prior art what coating should be selected for the protection of steel in a high temperature molten bromide medium in the presence of water such as one which is used in bromide-absorption cycles. A good example is the failure of titanium coatings in high temperature bromide media. Although the resistance of titanium to halide induced corrosion is well documented, we have found that titanium is readily attacked in high temperature bromide solutions. Similarly, Ti and other metals, such as V, Zr and their alloys, which are quoted often as corrosion resistant, may be attacked in the presence of sulfuric acid environments. Therefore, it is apparent that one cannot readily predict the suitability of a metal as a coating for materials exposed to bromide-based environments based upon the a general description of the corrosion resistance of the metal alone, nor can one readily predict the corrosion protection afforded by a given metal coating on a metal substrate.

An improved corrosion resistant surface layer on a metal substrate formed by laser-induced remelting and solidifying under an aqueous solution of metal ion and reducing agent is taught by Japanese Patent 61281856. Here, the surface layer is formed by a treatment involving remelting and solidifying the surface of the base material and consists of a number of minutely thin layers. The improved surface layer has a different composition from the base material. The method is used to impart a corrosion resistant layer to a metal, especially to stainless steel, for use, for example, in a nuclear fuel reprocessing plant, a chemical plant, nuclear power plant, absorption refrigerator, or in a semiconductor package. European Patent Publication 0488165 teaches the plating non-electrolytically, electrically, or by any other means, of copper and nickel on the surface of a copper heat transfer tube followed by diffusion of the copper and nickel, which is then work hardened by means of rolling, swaging or other known means. The procedure is applicable to any absorbing refrigerator using solutions such as an aqueous solution of lithium bromide or any other salt solution.

The diffusion coating of a metal by simultaneous deposition of Cr and Si onto the metal is taught by U.S. Pat. No. 5,492,727 and related U.S. Pat. No. 5,589,220. The method utilizes a halide-activated cementation pack with a dual halide activator. Codeposition of chromium and silicon coatings on iron-based alloys by pack cementation using a mixed activator, that is a fused salt solution of NaF and NaCl, is taught by U.S. Pat. No. 5,364,659.

A chemical vapor deposition (CVD) method for case hardening a ferrous metal interior tubular surface by exposure to diffusible boron with or without other diffusible elements such as silicon to enhance the wear, abrasion and corrosion resistance of the tubular surface is taught by U.S. Pat. No. 5,455,068. The use of chemical vapor deposition for deposit of aluminum and a metal oxide on substrates for improved corrosion, oxidation, and erosion protection is taught by U.S. Pat. No. 5,503,874.

A method for producing materials in the form of coatings or powders using a halogen-containing reactant which reacts with a second reactant to form one or more reactive intermediates from which the powder or coating may be formed by disproportionation, decomposition, or reaction is taught by U.S. Pat. No. 5,149,514.

U.S. Pat. No. 4,822,642 teaches a silicon diffusion coating formed in the surface of a metal article by exposing the metal article to a reducing atmosphere followed by treatment in an atmosphere of 1 ppm to 100% by volume silane, with the balance being hydrogen or hydrogen plus inert gas.

A method for depositing a hard metal alloy in which a volatile halide of titanium is reduced off the surface of a substrate and then reacted with a volatile halide of boron, carbon or silicon to effect the deposition on a substrate of an intermediate compound of titanium in a liquid phase is taught by U.S. Pat. No. 4,040,870.

The fact that the coatings disclosed by these references improve the corrosion resistance properties of a substrate material, even if only for a very short period of time, is obvious. However, the objective of any protective coating applied to a substrate metal is to provide corrosion protection properties to the substrate metal for extended periods of time when disposed in extremely aggressive environments such as bromide-based absorbents. In the case of bromide-based absorption systems, this means corrosion resistance properties better than the corrosion resistance properties of currently used expensive alloys, such as AL6XN® available from Allegheny Ludlum. The corrosion rate of AL6XN in bromide-based solutions is about 2.4 mils per year (mpy). By comparison, the corrosion rate of ANSI Type 409 stainless steel, a much less expensive metal than AL6XN, in a bromide-based solution is about 96 mpy. Thus, protective coatings which provide corrosion rates less than 96 mpy, more preferably less than 75 mpy, and most preferably less than about 2.4 mpy are required. None of the prior art references discussed herein provide any guidance with respect to coatings which, when applied to stainless steel substrates, provide the requisite corrosion resistant properties to the substrates when disposed in a bromide-based environment such as is encountered in bromide-based absorption systems.

SUMMARY OF THE INVENTION

Absorption cooling systems are heat driven refrigeration machines in which a secondary fluid, the absorbent, absorbs the primary fluid, gaseous refrigerant, that has been vaporized in an evaporator. In a typical single effect absorption refrigeration system, water is used as the refrigerant and lithium bromide as the absorbent. Other refrigerant/absorbent pairs (solutions) have been used, or have the potential for use, in absorption cycles.

In a single effect absorption chiller, refrigerant vapor is produced in an evaporator at a temperature somewhat below that of the heat load. The refrigerant vapor is exothermically absorbed by a concentrated absorbent solution entering the absorber. The heat of absorption is then transferred to a heat sink, such as cooling water, at the absorber. The dilute absorbent solution is then pumped to the generator, where it is concentrated again and returned to the absorber. External heat is supplied to the generator to supply the energy required to separate the refrigerant from the absorbent. The refrigerant is condensed at the condenser and is returned to the evaporator, while the concentrated absorbent is returned to the absorber. A heat exchanger between the absorber and generator is also part of the system, exchanging heat to the dilute absorbent from the concentrated absorbent solution. This process is carried out between two pressures, a lower pressure in the evaporator-absorber section and a higher pressure in the generator-condenser section. The operating temperature limits of the refrigerant/absorbent combinations are determined by the chemical and physical properties of the solution pair.

Advanced absorption systems fueled by natural gas may offer significant advantages over conventional heating, cooling, and refrigeration systems. These advanced systems include double effect, triple effect, and generator absorber heat exchange cycles. The advanced absorption systems reduce energy consumption, thus improving the economics of natural gas consumption. The reduced gas consumption per unit results in a lower operating cost to the consumer and lower emissions to the environment.

These advanced absorption systems transfer heat from both the absorber and condenser from a higher temperature absorption cycle using one refrigerant/absorbent pair to a second (or third) refrigerant/absorbent pair operating at a lower generator temperature. The triple effect chiller is 30% to 60% higher in coefficient of performance (COP) than a double effect cycle using equivalent heat exchangers. The triple effect chiller has the potential of being less expensive than double effect chillers because the triple effect chillers can use several existing absorption fluids. In addition, it uses only conventional heat exchangers and it requires less total heat exchanger per unit of capacity than single or double effect cycles. Water/LiBr, water/LiBr with additional absorbents, for example, $ZnBr_2$, LiCl, ammonia/water, and ammonia/water with other salts, for example LiBr, are some of the widely used absorbents and refrigerants. Conventional absorbent cycles operate in the range of 200° to 350° F., but triple effect and other advanced cycles operate at much higher temperatures in order to transfer absorber heat at temperatures up to 300° F. Because the condenser is also operating at 200° F. as well as being under high pressure, the generator temperatures must be very high, typically greater than 450° F. These very high temperatures result in very low concentrations of refrigerant in the liquid leaving the generator, which is extremely corrosive to the metals used in the construction of these heat exchangers.

The major barrier towards commercialization of advanced absorbent systems is the prohibitive cost of the construction material. The alloys that survive in salt mixtures at the extreme temperatures required for high COP are very expensive and difficult to machine. As a result, the use of efficient advanced absorption systems is not financially attractive.

Accordingly, it is an object of this invention to provide materials suitable for use in advanced absorption systems which are relatively low cost with respect to the expensive alloys currently required by advanced absorption systems, thereby eliminating the major barrier to the commercialization of such advanced absorption cycles.

It is another object of this invention to provide coated, low cost steel and other metals suitable for use in such advanced absorption cycles having the same or better corrosion resistance than the expensive alloys currently used.

It is yet another object of this invention to provide a method for producing such corrosion-resistant coated low cost steels and other metals.

These and other objects of this invention are addressed by a structure, such as a conduit or heat exchanger disposed in a bromide-based absorption system comprising stainless steel coated with a metallic coating comprising a metal selected from the group consisting of Cr, W, Si, Mo, Ti, Ni, Zr and mixtures thereof.

To produce the coated stainless steel of this invention, a metallic protective coating selected from the group consisting of Cr, W, Si, Mo, Ni, Ti, Zr and mixtures thereof is deposited onto a stainless steel substrate. The metallic protective coating is then diffused so as to form a diffusion layer between the metallic protective coating and the metal substrate. Optionally, the metallic protective coating may then be passivated, forming a stable compound selected from the group consisting of carbides, borides, nitrides, silicides, oxides and mixtures thereof on the metallic protective coating. Suitable deposition methods for deposition of the metallic protective coating on the metal substrate include chemical vapor deposition, pack cementation, and a fluidized bed reactor. The preferred means of deposition is by way of a fluidized bed reactor.

One of the benefits of this method for coating stainless steel and other metals is that it can be applied to a variety of convoluted geometries such as heat exchangers or bundles of tubes producing, for example, a heat exchanger suitable for use in a bromide-based absorption cycle wherein the heat exchanger comprises a metallic protective coating selected from the group consisting of Si, Cr, W, Mo, Ni, Ti, Zr and mixtures thereof, and a diffusion layer formed by diffusion of the metallic protective coating disposed between the substrate metal and the metallic protective coating.

BRIEF DESCRIPTION OF THE DRAWINGS

These and other object and features of this invention will be better understood from the following detailed description taken in conjunction with the drawings wherein.

DESCRIPTION OF PREFERRED EMBODIMENTS

Coatings are widely used for corrosion protection of metals and other materials in a variety of environments. The coatings and methods for producing such coatings in accordance with this invention significantly reduce the corrosion rate of steels and other metals used in bromide-based absorption cycles. These coatings allow the use of low cost steels, preferably stainless steel, as the construction material in place of expensive alloys, increase the operating temperature of such cycles (up to 300° C.), thereby improving the coefficiency of performance, and extend service life, thereby reducing replacement and maintenance costs. We have found that the corrosion-resistant coatings for low cost steels in accordance with this invention produce coated, low cost steel having the same or better corrosion resistance than expensive alloys. In addition, the coatings, as well as the coating method, in accordance with this invention have a substantial economic advantage over the use of the more expensive alloys.

We have found that the coatings in accordance with this invention significantly reduce the rate of corrosion of, for example, ANSI Type 409 stainless steel in high temperature bromide solutions. The metallic protective coatings of this invention comprise an outer metallic material layer selected from the group consisting of Si, Cr, W. Mo, Ni, Ti Zr and mixtures thereof which is deposited onto a metal substrate and a diffusion layer disposed between said outer metallic material layer and said metal substrate. The outer metallic material layer is treated so as to diffuse a portion of the outer metallic material layer into the metal substrate, forming a diffusion layer between the outer metallic material layer and the metal substrate. Coatings with some degree of diffusion, as in the coatings of this invention, have a compositionally-gradient interface between the substrate and the coating and, thus, do not delaminate upon temperature cycling or exposure to aggressive environments. The coating metal and the substrate metal are interdiffused to some extent, thereby forming an alloy at the interface. By controlling parameters associated with the coating method of this invention, using Si coatings we can obtain a surface composition and grain size having corrosion-resistant properties similar to a corrosion-resistant alloy such as DURIRON®, a very brittle alloy comprising about 75 weight % iron and about 14–17 weight % Si, and using Cr, we can obtain a surface composite having corrosion resistant properties similar to AL6XN, a Cr—Mo—Ni alloy having about 21% by weight Cr, about 7% by weight Mo and about 24.5% by weight Ni. After formation of the diffusion layer, in accordance with one embodiment of this invention, the outer metallic material layer may be passivated, thereby forming a stable compound selected from the group consisting of carbides, borides, nitrides, silicides, oxides, and mixtures thereof on the metal protective coating.

Figure 1:
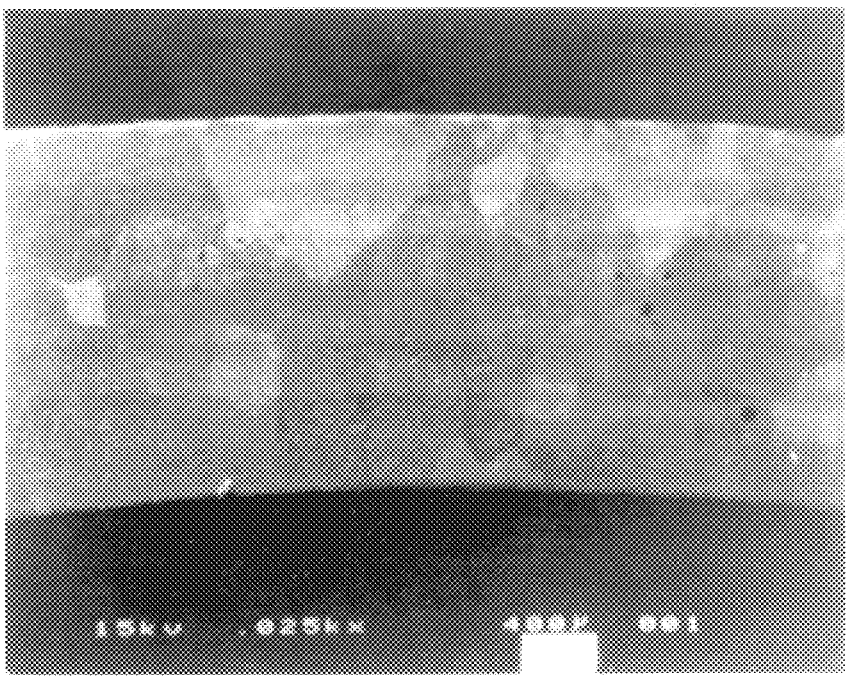
FIG. 1 is a micrograph showing a cross-section of a chromium diffusion coating prepared by pack cementation on ANSI Type 409 stainless steel.
Figure 2:
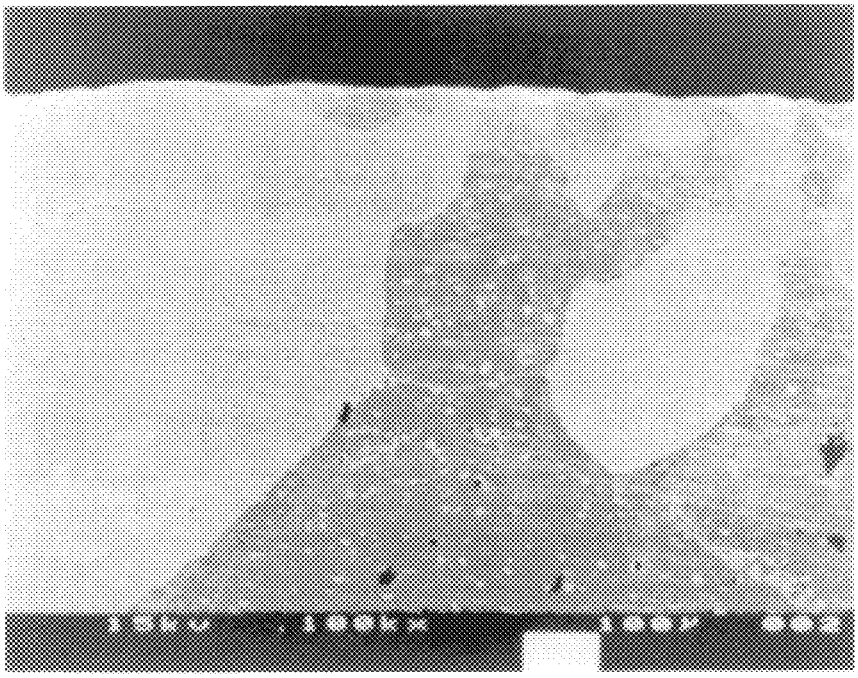
FIG. 2 is a micrograph showing a cross-section of a chromium diffusion coating prepared by pack cementation on ANSI Type 409 stainless steel at higher magnification than shown in FIG. 1.
Figure 4:
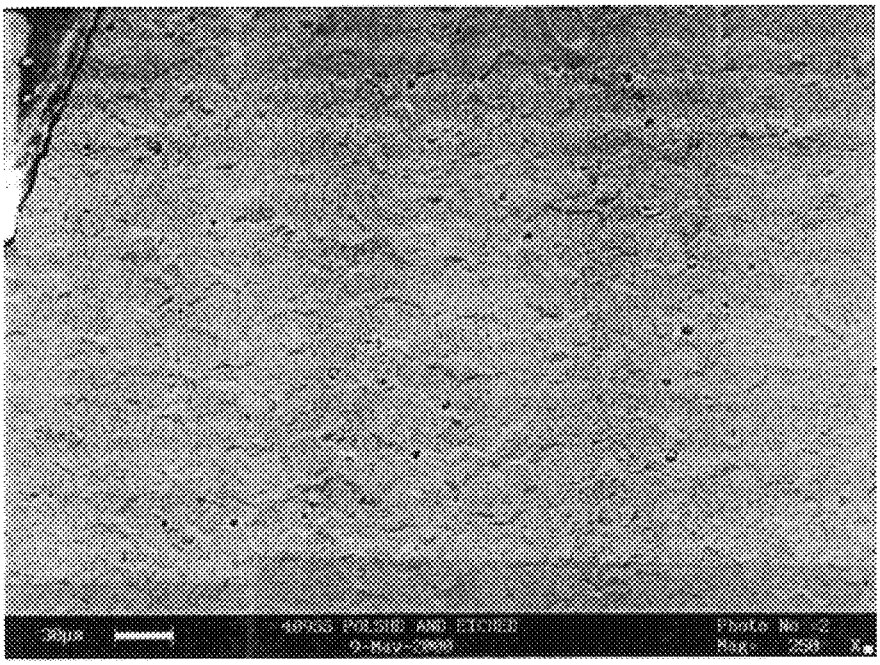
FIG. 4 is a micrograph showing a cross-section of as-received ANSI Type 409 stainless steel.

For example, FIGS. 1 and 2 show micrographs of a chromium diffusion coating on ANSI Type 409 stainless steel prepared by conventional pack cementation. On average, the grains are over 100–200 microns compared with the 30–40 micron grains of as-received ANSI Type 409 stainless steel, showing grain growth during the coating process. The extensive grain growth observed in the conventional pack cementation process prohibits use of these coatings in most applications. As the grain sizes become large, metals tend to become brittle and, thus, prone to stress, causing a new set of problems in spite of improved corrosion resistance. FIG. 4 shows the cross-section of an as-received ANSI Type 409 stainless steel specimen.

Figure 3:
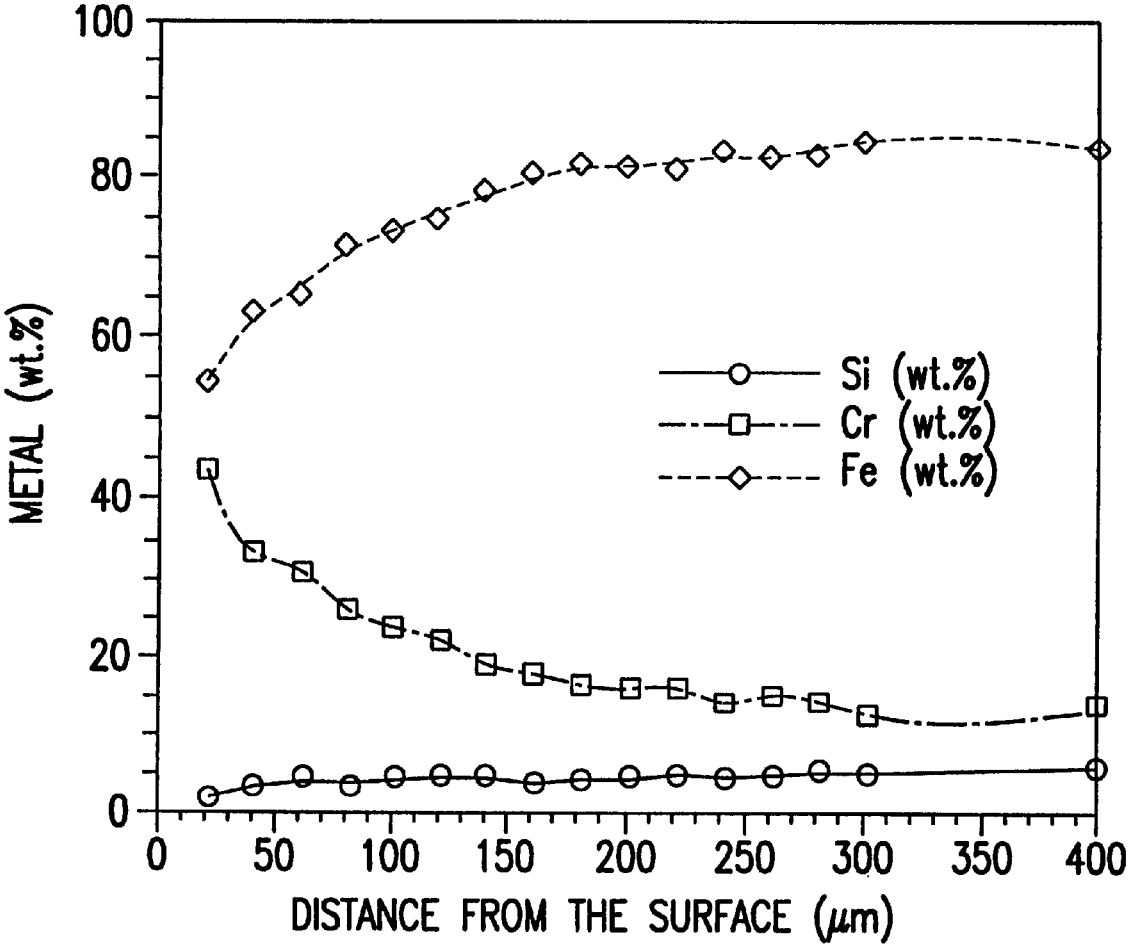
FIG. 3 is a graphic depiction showing the depth profile of chromium diffusion on an ANSI Type 409 stainless steel substrate.
Figure 5:
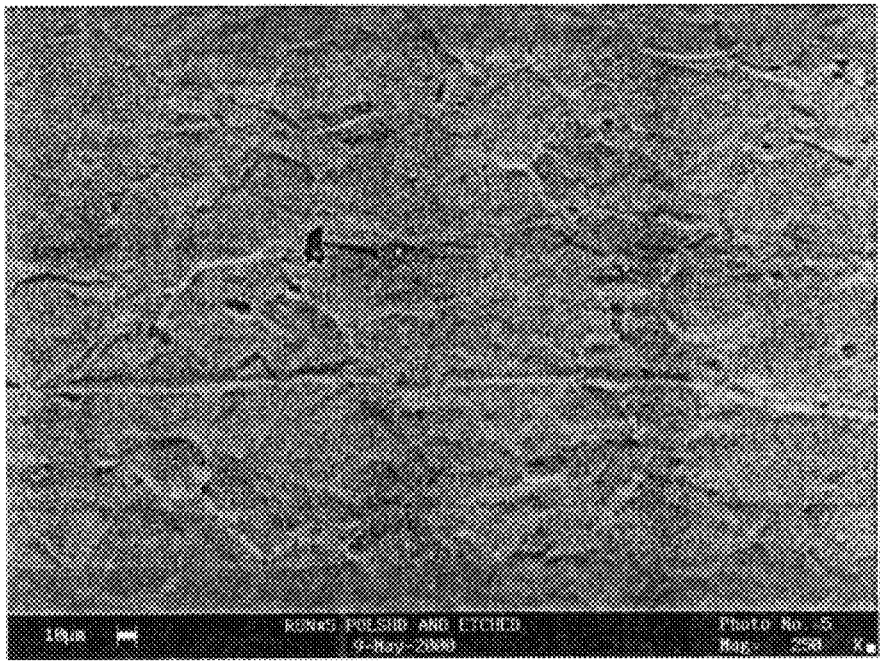
FIG. 5 is a micrograph showing a cross-section of a Cr-coated ANSI Type 409 stainless steel prepared using a fluidized bed chemical vapor deposition process.

FIG. 3 shows the depth profile of the chromium diffusion. The Cr concentration on the surface is very high (about 44% by weight of the coated metal) and decreases to about 10% by weight (bulk concentration of Cr in uncoated 409 SS) at a depth of about 400 microns. Even at a depth of 100 microns, the Cr concentration is greater than about 23 weight percent, more than that of AL6XN®, the currently used alloy for prototype triple effect generators. The metallic protective coating of this invention may be deposited onto the metal substrate by any suitable deposition process, including chemical vapor deposition, pack cementation and in a fluidized bed reactor. The use of a fluidized bed reactor is preferred. FIG. 5 shows the cross-section of a Cr-coated ANSI Type 409 stainless steel prepared by a fluidized bed chemical vapor deposition process in accordance with the method of this invention. As clearly shown, in contrast to the results obtained using pack cementation as previously discussed, the microstructure of the underlying base metal has been changed minimally from the original state.

EXAMPLE 1

ANSI Type 409 SS coupons, one square inch, were coated with Si, Cr, W and Mo by chemical vapor deposition. Halide chemistry in a fluidized bed reactor or pack cementation process was employed for Si and Cr deposition. The coating temperatures for Si and Cr were 550° C. and 1,000° C., respectively. In accordance with the preferred method of this invention, the chemical vapor deposition coating technique was carried out in a fluidized bed reactor, which is particularly suitable for coating convoluted geometries, such as heat exchangers or bundles of tubes. Fine powders of the metal to be deposited are pneumatically injected in and through the heat exchanger system in, for example, an argon carrier containing 1–5% of an $H_2$—HCl mixture. In the case of Si, the reaction with HCl produces a mixture of $SiH_4$, $SiHCl_3$, $SiH_2Cl_2$, and $SiCl_2$ vapors which transport the Si from the particles to the surface of the metallic wall where they are reduced. The metallic walls of the heat exchanger act as a sink because the activity of Si in them is typically very low (less than about 1%) while the gas is saturated. In the initial stages, deposition and diffusion are very fast for stainless steel above 550° C.

EXAMPLE 2

Tungsten and molybdenum were deposited on ANSI Type 409 stainless steel by chemical vapor deposition at 450° C. using the respective carbonyl as a precursor. Although not intending to be bound or limited in any way by this explanation, we believe that the reaction may be a decomposition reaction such as that from a carbonyl:

$$M(CO)n \rightarrow M+nCO$$

where typical cases may include $$Nb(CO)_6=Nb+6CO$$

$$W(CO)_6=W+6CO$$

$$Mo(CO)_6=Mo+6CO$$

$$Cr(CO)_6=Cr+6CO$$

or mixtures of metal carbonyls such as $$W(CO)_6+Cr(CO)_4=W-Cr(\text{on steel})+10CO$$

where it forms a W–Cr coating on the substrate. However, the reaction may also be a decomposition of a hydride or other substitute that disproportionates on steel. The gas may be injected as a vapor or as a condensed powder or absorbed liquid. For example, in the case of hydrides, the deposition reactions are as follows:

$$SiH_4 \rightarrow Si(\text{on steel})+2H_2$$

$$GeH_4 \rightarrow Ge(\text{on steel})+2H_2$$

$$B_2H_6 \rightarrow 2B(\text{on steel})+3H_2$$

$$SiHBr_3+2H_2 \rightarrow Si(\text{on steel})+6HBr$$

Diffusion of the outer metallic material layer into the metal substrate to form a diffusion layer, in accordance with one embodiment of this invention, is carried out by annealing the metal surface coated with the outer metallic material layer. The resulting coated surface of the substrate can then be further protected by application of surface passivation as the final step in the diffusion coating process. Although any suitable surface passivation technique may be used, the preferred procedure is in a fluidized bed reactor, most commonly for surface nitridation. As an example, after the protective metal, for example Si or Ti, is deposited on the metal substrate, the coated surface is exposed to 2% $NH_3$ as the final step in the coating process. Ammonia reacts with silicon and/or titanium to form extremely protective thin silicon or titanium nitride films. This process has also been used to passivate coated surfaces resulting in the formation of corrosion-protective surface compounds selected from the group consisting of carbides, borides, nitrides, suicides, oxides, and mixtures thereof.

To establish the corrosion resistance of the coatings of this invention, coated ANSI 409 stainless steel specimens were exposed to 90% lithium bromide and zinc bromide solution at 260° C. in a laboratory test setup. This salt mixture was chosen due to its favorable thermodynamic properties for advanced absorption cycles. It is also known to be more corrosive than other commonly used bromide-based salt combinations. Numerous metals and alloys were also tested for comparison and identification of coating metals. The corrosion rates were measured using a weight loss technique, DC corrosion experiments, and electrochemical impedance analysis. In the DC corrosion experiment, the metal specimen was polarized anodically and cathodically 100 mV from the natural corrosion potential. The resulting current was plotted in a log I versus E graph and fitted to the Sten-Geary equation using a nonlinear least squares technique to obtain anodic and cathodic Tafel slopes ($b_a$ and $b_c$), and the corrosion rate. In the AC impedance analysis, a small sinusoidal waveform (5 mV) was applied on the electrode at the natural corrosion potential of the metal. The frequency of the sine wave was swept from about 10 kHz to 1 MHZ and the resulting current information was collected along with its phase relationship to the original waveform and presented in Nyquist plots ($Z_{imaginary}$ versus $Z_{real}$). Polarization resistance, which is inversely proportional to the corrosion current, was calculated from the X-axis intercepts of the semicircle fit. The proportionality constant is a function of anodic and cathodic Tafel slopes. Therefore, the corrosion rate can be calculated using polarization resistance from AC impedance analysis and Tafel slopes from a DC potential scan. In some cases, AC impedance itself is used as a quantitative measure of corrosion protection by comparing polarization resistance of coated and uncoated specimens.

Table 1 summarizes the corrosion rates of some pure metals and expensive alloys in 90% lithium bromide and zinc bromide solution at 260° C. Table 2 summarizes the corrosion rates of coated ANSI Type 409 stainless steel in a 90% lithium bromide and zinc bromide solution at 260° C.

TABLE 1

Corrosion rates of pure metals and alloys in 90% lithium bromide and zinc bromide solution at 260° C.

| Tested Metals and Alloys | Corrosion Rate (mpy) |
|---|---|
| Mo | 0.04 |
| W | <0.01 |
| Ni | 0.11 |
| Ti | 28.5 |
| Si | <0.01 |
| Zr | <0.01 |
| Ta | 0.01 |
| Mild Steel | >1000 |
| ANSI Type 409 SS (Reference) | 96 |
| DURIRON ® | 1.1 |
| AL6XN ® (Reference-Goal) | 2.4 |

TABLE 2

Corrosion rates of coated steels in 90% lithium bromide and zinc bromide solution at 260° C.

| Coatings and Substrate | Corrosion Rate (mpy) |
|---|---|
| (a) Single Metal Coatings | |
| W-coated ANSI Type 409 SS | 74.7 |
| Si-coated ANSI Type 409 SS | 24.0 |
| Mo-coated ANSI Type 409 SS | 15.7 |
| Cr-coated ANSI Type 409 SS | 0.01 |
| Cr-coated mild steel | 76 |
| (b) Mixed Metal Coatings | |
| Si + Al-coated ANSI Type 409 SS | 45 |
| Si + Ti-coated ANSI Type 409 SS | 14 |
| Si + Mo-coated ANSI Type 409 SS | 14.4 |
| Cr + Mo-coated ANSI Type 409 SS | 0.02 |
| Cr + W-coated ANSI Type 409 SS | 0.02 |
| Cr + Ni-coated ANSI Type 409 SS | 0.02 |

The data clearly show that, based upon the corrosion resistance of a pure metal, one skilled in the art cannot conclude the satisfactory performance of the same metal when used as a coating on stainless steel. For example, Mo, Si and W, when tested alone show corrosion rates less than 0.04 mpy, yet when applied as a single metal coating to ANSI Type 409 stainless steel, the corrosion rate is substantially higher. And, although providing improved corrosion resistance to ANSI Type 409 stainless steel where they were used as a coating, the rate of corrosion is substantially higher than would be expected based upon the corrosion resistance of the pure metals and is substantially higher than the corrosion rate of the expensive alloys, DURIRON and AL6XN. In addition, although these coatings reduced the rate of corrosion of the base metal in laboratory experiments, these coatings would have no practical importance in a field application because the corrosion rates of these coatings are significantly greater than that of the AL6XN alloy presently employed in the prototype development of hot bromide solutions based triple effect chillers. A corrosion rate of 14 mpy will expose the base metal of a specimen coated 300 $\mu$m thick with Si+Mo coating within a year. Therefore, coatings such as W, Mo, Si, Mo+Si cannot be used to protect low cost alloys such as ANSI Type 409 stainless steel in aggressive high temperature, concentrated bromide environments.

Only Cr, which also exhibits superior corrosion rates when tested as a pure metal, when used as a coating on ANSI Type 409 stainless steel, produces a coating which has a corrosion rate less than the reference alloy, AL6XN. Even with Cr coatings, experimental conditions and precursors need to be optimized to achieve the excellent corrosion resistant properties. For example, Cr coating prepared by metal organic chemical vapor deposition showed a corrosion rate of47 mpy in 260° C., 90% bromide solution. The Cr coating prepared by fluidized bed reactor chemical vapor deposition in accordance with the method of this invention showed only a 0.01 mpy rate of corrosion under the same conditions.

In addition to Cr, the data show that multiple-metal coatings which have Cr as one of the elements reduce the corrosion rate considerably. In particular, coatings comprising Cr+Mo, Cr+W, or Cr+Ni provide corrosion resistance three orders of magnitude superior to that of AL6XN currently used in prototype development. Advantages of having multiple elements is that one can impart other desirable properties, such as stress corrosion cracking resistance, high hydrogen overpotential, ductility, etc. to the coating. Thus, it is possible to include other metals in the Cr coating without losing the corrosion resistant properties of the coating.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. In a structure in contact with a bromide-based fluid and comprising stainless steel, the improvement comprising:

said stainless steel coated with a metallic coating comprising a metal selected from the group consisting of Cr and a metal alloy comprising Cr and a metal selected from the group consisting of Mo, W, Ni, Si, Zr and mixtures thereof, and having a diffusion layer disposed between said stainless steel and said metallic coating.

2. A structure in accordance with claim 1, wherein said stainless steel is ANSI Type 409 stainless steel.

3. A structure in accordance with claim 1 further comprising at least one compound selected from the group consisting of carbides, borides, nitrides, silicides, oxides and mixtures thereof passivated onto said metallic coating.

4. In a structure in contact with a bromide-based fluid and comprising stainless steel, the improvement comprising:

said stainless steel coated with a metallic coating comprising Cr and having a corrosion rate of less than about 2.4 mpy when applied to said stainless steel; and a diffusion layer disposed between said stainless steel and said metallic coating.

5. A structure in accordance with claim 4, wherein said metallic coating comprises a metal selected from the group consisting of Mo, W, Ni, Si, Zr and mixtures thereof.

6. A structure in accordance with claim 4, wherein said stainless steel is ANSI Type 409 stainless steel.

7. A structure in accordance with claim 4 further comprising at least one compound selected from the group consisting of carbides, borides, nitrides, silicides, oxides and mixtures thereof passivated onto said metallic coating.

8. In a bromide-based absorption system comprising an absorber, a condenser, a generator, heat exchange means and a bromide-based absorbent, the improvement comprising:

said heat exchange means comprising stainless steel coated with a metallic coating comprising a metal selected from the group consisting of Cr and a metal alloy comprising Cr and a metal selected from the group consisting of Mo, W, Ni, Si, Zr and mixtures thereof; and a diffusion layer formed by diffusion of said metal disposed between said stainless steel and said metal coating.

9. A bromide-based absorption system in accordance with claim 8, wherein said stainless steel is ANSI Type 409 stainless steel.

10. A bromide-based absorption system in accordance with claim 8, wherein said heat exchange means further comprises at least one compound selected from the group consisting of carbides, borides, nitrides, silicides, oxides and mixtures thereof passivated onto said metallic coating.

* * * * *